US008272457B2

(12) United States Patent
Pardey

(10) Patent No.: US 8,272,457 B2
(45) Date of Patent: Sep. 25, 2012

(54) DETACHABLE LATCH HEAD FOR CORE DRILLING

(76) Inventor: Harold M Pardey, Sarasota, FL (US)

( * ) Notice: Subject to any disclaimer, the term of this patent is extended or adjusted under 35 U.S.C. 154(b) by 440 days.

(21) Appl. No.: 12/404,628

(22) Filed: Mar. 16, 2009

(65) Prior Publication Data

US 2009/0229884 A1 Sep. 17, 2009

Related U.S. Application Data

(60) Provisional application No. 61/037,140, filed on Mar. 17, 2008.

(51) Int. Cl.
*E21B 49/02* (2006.01)

(52) U.S. Cl. ..... 175/246; 166/240; 166/242.6

(58) Field of Classification Search ..... 175/246; 166/340, 242.6, 338
See application file for complete search history.

(56) References Cited

U.S. PATENT DOCUMENTS 3,123,160 A * 3/1964 Kammerer ..... 175/82
4,702,327 A * 10/1987 Barrett ..... 175/4
4,834,198 A * 5/1989 Thompson ..... 175/244
5,228,507 A * 7/1993 Obrejanu et al. ..... 166/98
5,267,620 A * 12/1993 Lee ..... 175/230
6,029,758 A * 2/2000 Novacovicci et al. ..... 175/234
6,089,335 A * 7/2000 Able ..... 175/246
6,095,259 A * 8/2000 Keyes ..... 175/20
6,425,449 B1 7/2002 Marshall
6,659,204 B2 12/2003 Aumann et al.
6,705,411 B2 * 3/2004 Looijen et al. ..... 175/6
6,908,264 B1 * 6/2005 Gundy ..... 408/204
7,380,614 B1 * 6/2008 Williamson et al. ..... 175/6
7,921,926 B2 * 4/2011 Drenth et al. ..... 166/385

OTHER PUBLICATIONS

International Search Report and Written Opinion, Application No. PCT/US09/37249.

* cited by examiner

*Primary Examiner* — Daniel P Stephenson
*Assistant Examiner* — Kipp Wallace
(74) *Attorney, Agent, or Firm* — Richard A. Fagin

(57) ABSTRACT

A latch head assembly for a core receiving apparatus including a core tube assembly and a retrieving head is provided. The latch head assembly includes a support, a first coupling for releasably engaging the retrieving device coupled to a first end of the support, and a second coupling for releasably engaging the core tube assembly coupled to a second end of the support. A core receiving apparatus including the latch head assembly is also provided. A method for inserting and retrieving the core receiving apparatus into and from a drill string is also provided.

7 Claims, 8 Drawing Sheets

DETACHABLE LATCH HEAD FOR CORE DRILLING

CROSS-REFERENCE TO RELATED APPLICATIONS

This application claims benefit of Provisional Application No. 61/037140, filed Mar. 17, 2008, the entire disclosure of which is incorporated herein by reference.

STATEMENT REGARDING FEDERALLY SPONSORED RESEARCH OR DEVELOPMENT

Not Applicable

FIELD

The invention relates generally to methods and apparatus for core drilling. More specifically, the invention relates to a wireline core receiving apparatus insertable into and retrievable from a core drill string.

BACKGROUND

Core drilling is used to collect a core sample from a subsurface formation that can be analyzed to determine the composition of the formation. To collect the core sample, a core drill string is lowered into a borehole traversing the formation. The core drill string typically includes a drill stem with an annular drill bit appended at an end thereof for cutting the formation. A core tube assembly is disposed within the drill stem to collect the core sample from the formation. In wireline core drilling, the core tube assembly can be retrieved from the drill stem without removing the core drill string from the borehole. This allows multiple core samples to be collected without removing the core drill string from the borehole in between each collection of core sample. The core tube assembly is run into the drill stem at the end of an overshot attached to a wireline. The core tube assembly can be retrieved from the drill stem by pulling back the wireline.

U.S. Pat. No. 3,701,389 (Egnelov et al., Oct. 31, 1972) discloses a retrievable inner core tube assembly with means for releasably locking the inner core tube assembly to a drill stem. In this patent, the inner core tube assembly includes an inner core tube, an intermediate piece, and a housing. Two latch dogs, pivotally mounted on a stub axle, are disposed in the housing. Each latch dog has two arms. One of the arms on each latch dog is arranged to engage a retrieving device while the other of the arms on each latch dog is arranged to lock the inner core tube assembly to the drill stem when the inner core tube assembly is inserted in the drill stem.

SUMMARY

In a first aspect, the invention relates to a latch head assembly for a core receiving apparatus including a core tube assembly and a retrieving device. The latch head assembly comprises a support, a first coupling coupled to a first end of the support for releasably engaging the retrieving device, and a second coupling coupled to a second end of the support for releasably engaging the core tube assembly.

In a second aspect, the invention relates to a core receiving apparatus. The core receiving apparatus comprises a core tube assembly, a retrieving device, and a latch head assembly as described above.

In a third aspect, the invention includes a method for inserting and retrieving a core receiving apparatus into and from a drill string. The method comprises (a) providing a latch head assembly comprising a housing, a first coupling coupled to a first end of the housing, and a second coupling coupled to a second end of the housing; (b) attaching the first coupling to a retrieving device; (c) attaching the second coupling to a core tube assembly; (d) lowering the core tube assembly into the drill string with the latch head assembly and retrieving device; (e) retrieving the core tube assembly with the latch head assembly and retrieving device from the drill string; and (f) releasing the latch head assembly from the core tube assembly by releasing the second coupling from the core tube assembly.

Other aspects of the invention will be apparent from the following description and the appended claims.

BRIEF DESCRIPTION OF DRAWINGS

The accompanying drawings, described below, illustrate typical embodiments of the invention and are not to be considered limiting of the scope of the invention, for the invention may admit to other equally effective embodiments. The figures are not necessarily to scale, and certain features and certain views of the figures may be shown exaggerated in scale or in schematic in the interest of clarity and conciseness.

DESCRIPTION OF EMBODIMENTS

Figure 10:
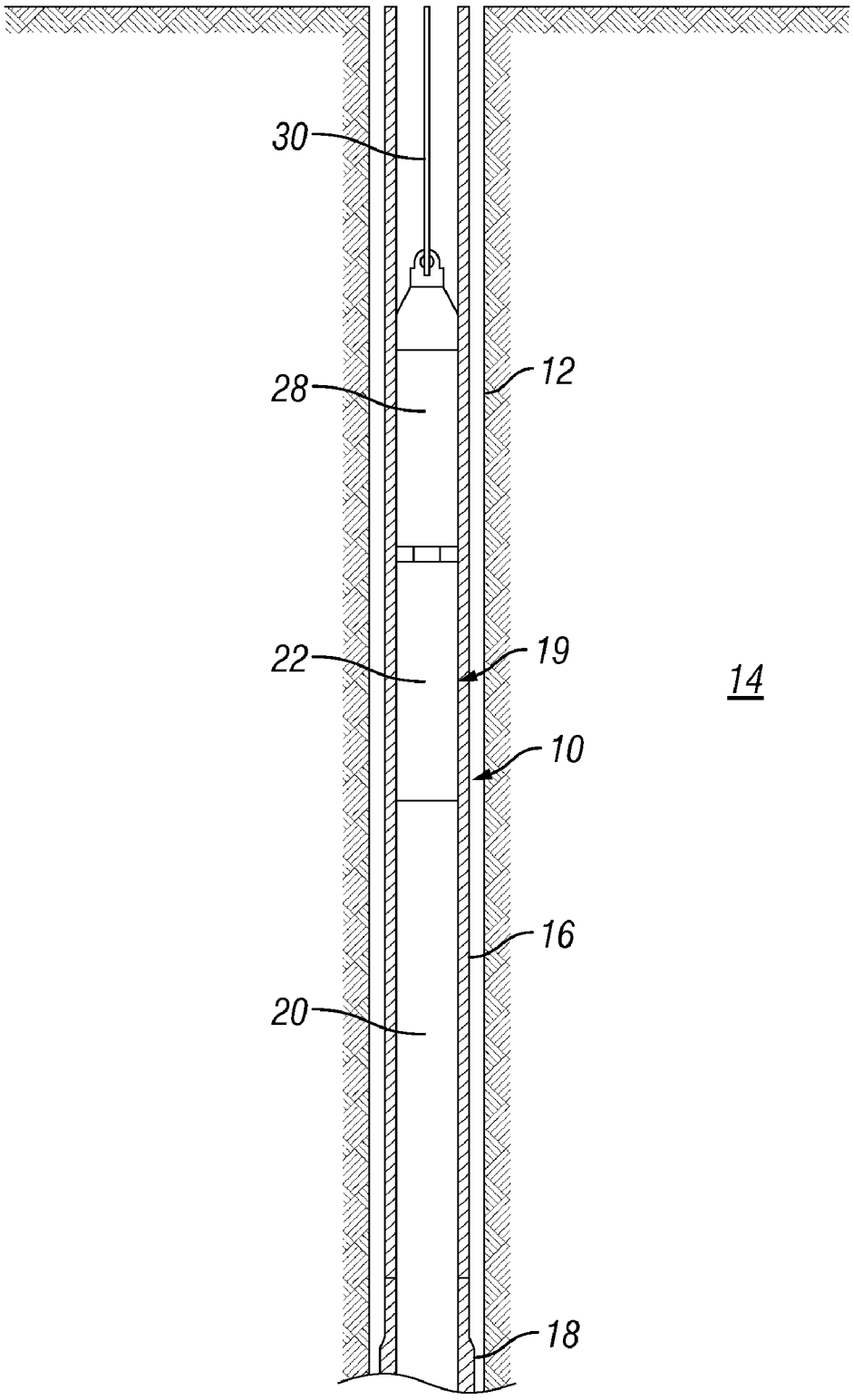
FIG. 10 shows a core drill string disposed in a borehole and a core receiving apparatus disposed in the core drill string.

FIG. 10 depicts a core drill string 10 disposed in a borehole 12 drilled through a subsurface formation 14. The core drill string 10 includes a drill stem 16 and a drill bit 18 appended to an end of drill stem 16. The drill bit 18 may be an annular drill bit. A retrievable core receiving apparatus 19 is disposed in the bore of the drill stem 16. The core receiving apparatus 19 includes a core tube assembly 20 disposed near the drill bit 18. The inner core tube assembly 20 includes container(s), not identified separately, for collecting core samples from the subsurface formation 14 cut by the drill bit 18. The core receiving apparatus 19 includes a latch head assembly 22 coupled to the core tube assembly 20. The core receiving apparatus 19 also includes a receiving device 20. The latch head assembly 22 releasably couples the core tube assembly 20 to the retrieving device 28, as will be explained below. The retrieving device 28 may be an overshot and may be attached to an end of a wireline 30, wherein retrieval of the core receiving apparatus 19 from the drill stem 16 includes pulling the wireline 30 out of the drill stem 16.

Figure 1:
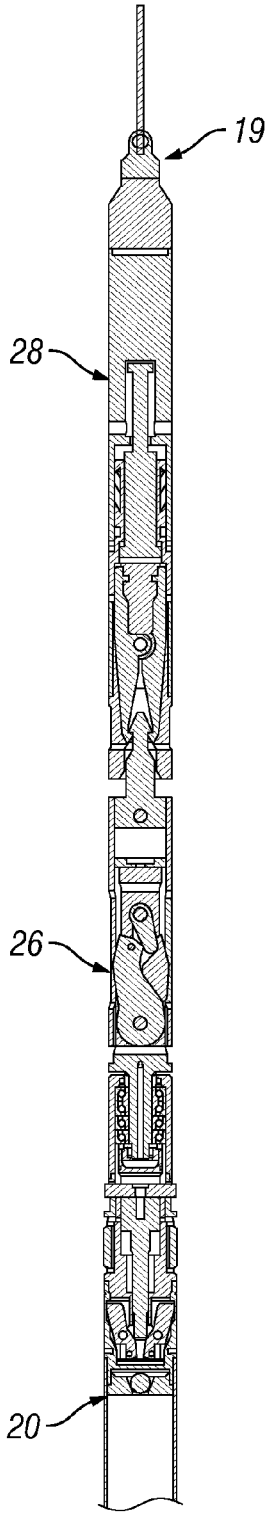
FIG. 1 is a cross-section of a core sample receiving apparatus.
Figure 2:
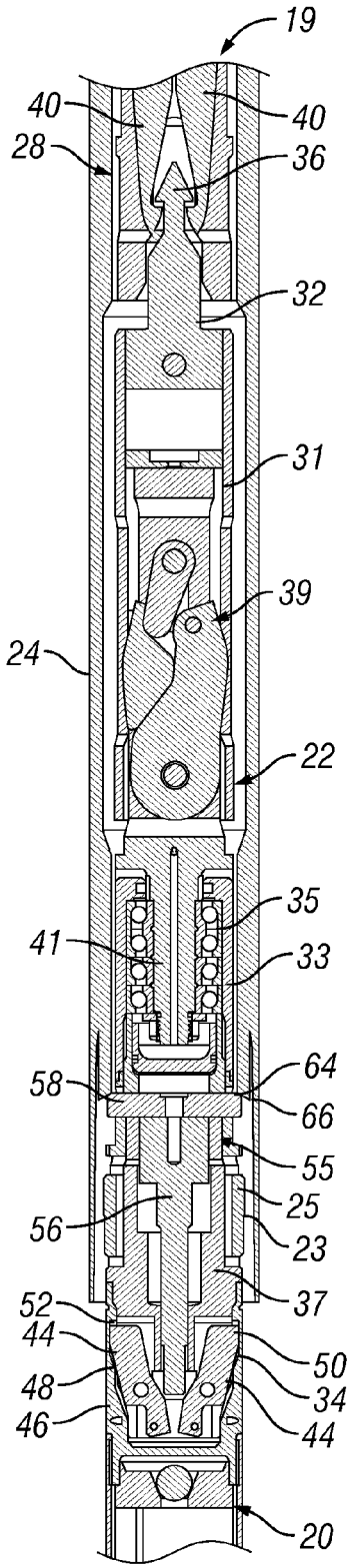
FIG. 2 is an enlarged cross-section of a first example of a latch head aligned with a retrieving device and a core tube assembly.

FIG. 1 is a cross-section of the core sample receiving apparatus 19. FIG. 2 is a close-up view of the connections between the latch head assembly 22 and the retrieving device 28 and core tube assembly 20. A guide tube 24 assists in aligning the retrieving device 28 with the latched head assembly 26. Typically, the guide tube 24 is removed after coupling the latch head assembly 26 to the core tube assembly 20 and before running the core sample receiving apparatus 19 into the bore of the drill stem (16 in FIG. 10). In FIG. 2, the latch head assembly 22 includes a first coupling, generally indicated at 32, for releasably engaging the retrieving device 28, and a second coupling, generally indicated at 34, for releasably engaging the core tube assembly 20. In the example shown in FIG. 2, a releasable connection between the first coupling 32 and the retrieving device 28 is provided by latch dogs 40 on the retrieving device 28 and a spearhead 36 on the first coupling 32. In an alternate embodiment, the latch dogs 40 may be provided on the first coupling 32 while the spearhead 36 is provided on the retrieving device 28. In the example shown in FIG. 2, the first coupling 32 is coupled to one end of a housing 31. A latch mechanism 39 is received in the housing 31. A support shaft 41 of the latch mechanism 39 extends from the housing 31 into another housing 33. The support shaft 41 is supported on bearings 35 within the housing 33. Both the housing 33 and support shaft 41 can rotate on the bearings 35. The support shaft 41 is coupled to a plunger 56 extending into a coupling body 37 of the second coupling 34. The latch mechanism 39 is used to displace the plunger 56 along an axial direction of the coupling body 37. A sleeve 25 is provided on the coupling body 37. The sleeve 25 includes a landing shoulder 23 that lands and stops in a drill string (e.g., drill string 10 in FIG. 10) when the core receiving apparatus 19 is lowered into the drill string. The bearings 35 isolate the rotating drill string (not shown) and latch mechanism 39 from the core tube assembly 20 while the drill string is drilling. The housing 33 also rotates and isolates the core tube assembly 20 from the rotating drill string.

Latches 44 are pivotally mounted to the coupling body 37 of the second coupling 34. The latches 44 may be spring-loaded, where the loading of the spring biases the latches 44 outwardly. A releasable connection between the second coupling 34 and the core tube assembly 20 is provided by the latches 44 and a tube cap 46 at the tip of the core tube assembly 20. The tube cap 46 has a bore 48 for receiving the latches 44. When the latches 44 are inserted in the bore 48, the latches 44 expand to engage the wall 50 of the tube cap 46. The wall 50 includes a shoulder 52 for retaining the latches 44 within the bore 48 once the latches 44 have expanded to engage the wall 50. The latch head assembly 22 includes a latch release surface to which a force may be applied to separate the second coupling 34 from the core tube assembly 20. The latch release surface may be provided, for example, by a T-bar 58 disposed between the first coupling 32 and the second coupling 34. In certain examples, force is applied to the T-bar 58 using a mechanically-operated sleeve that pushes down on the T-bar 58 or by pulling the T-bar 58 relative to the guide tube 24 until the T-bar 58 abuts a shoulder 64 on the wall 66 of the guide tube 24. The guide tube 24 may act as the mechanically-operated sleeve and can be pushed down until the shoulder 64 contacts the T-bar 58 in order to apply force to the T-bar 58. In one example, the plunger 56 disposed axially within the coupling body 37 is coupled to the T-bar 58. Force applied to the plunger 56 through action on the latch release surface, e.g., the surface of the T-bar 58, causes the plunger 56 to move axially relative to the coupling body 37 and apply a force on the latches 44, thereby releasing the latches 44 from the wall 50 of the tube cap 46.

To attach the latch head assembly 22 to the core tube assembly 20, the latches 44 of the second coupling 34 are inserted into the bore 48 of the tube cap 46 of the core tube assembly 20. The latches 44 expand inside the bore 48, as explained above, to engage the wall 50 of the tube cap 42. The latches 44 abut the shoulder 52 on the wall 50 of the tube cap 42 and thereby remain engaged with the tube cap 42 until it is time to detach the latch head assembly 22 from the core tube assembly 20. Although not shown, a stop pin or similar structure in the tube cap 46 may engage one of the latches 44 and thereby keep the latches 44 from freely rotating within the bore 48 of the tube cap 42. To detach the latch head assembly 22 from the core tube assembly 20, the latch head assembly 22 may be pulled into the guide tube 24 until the T-bar 58 contacts a shoulder 64 or shoulder 64 may be pushed down mechanically to apply a force on the T-bar 58, generally against the action of a spring (e.g., 72 in FIG. 8) biasing the plunger 56 in an upward direction. This causes the T-bar 58 to push down on the plunger 56. The plunger 56 in turn pushes down on the latches 44, causing the latches 44 to retract from the wall 50 of the tube cap 46, at which point the latches 44 can be removed from the bore 48 of the tube cap 46.

Figure 8:
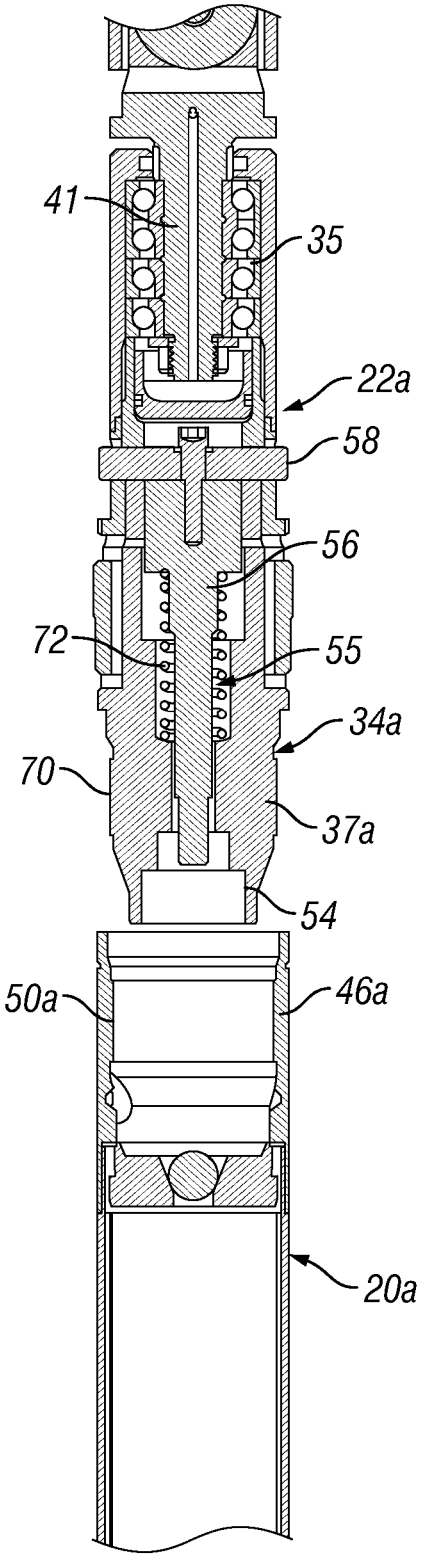
FIG. 8 is an enlarged cross-section of a second example of a latch head aligned with a core tube assembly.
Figure 9:
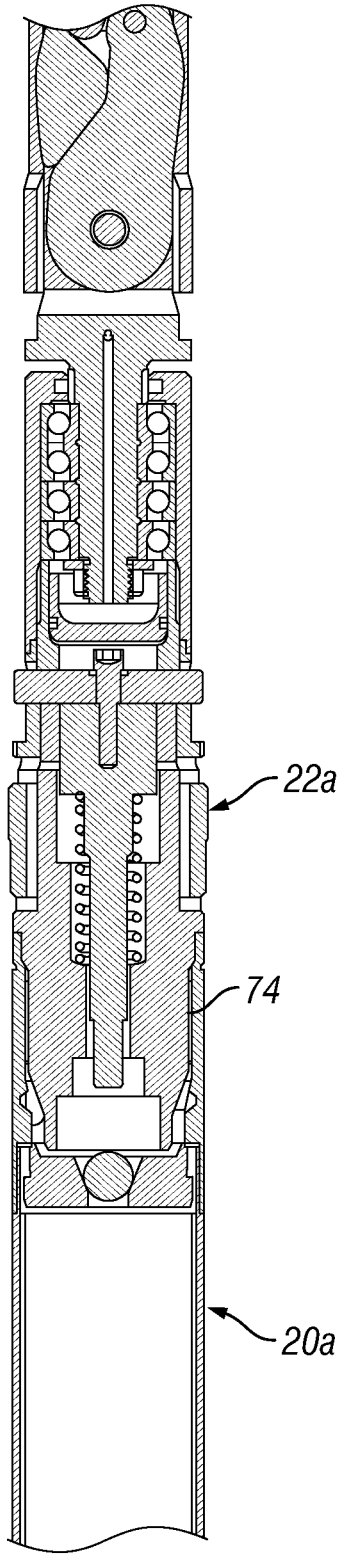
FIG. 9 shows the latch head and core tube assembly of FIG. 8 in a mated position.

FIG. 8 shows another example 22*a* of the latch head assembly (22 in FIGS. 1 and 2) with a different second coupling 34*a*. The first coupling of latch head assembly 22*a* is similar to the one shown in FIGS. 1 and 2. In the example of FIG. 8, the coupling body 37*a* of the second coupling 34*a* includes a surface 70 having a thread formed thereon. Similarly, a thread is formed on the wall 50*a* of the tube cap 46*a* of the core tube assembly 20*a*. The thread on the wall 50*a* of the tube cap 46*a* is designed to mate with the thread on the surface 70 of the coupling body 37*a*. For example, the thread on the surface 70 of the coupling body 37*a* can be a male thread while the thread on the wall 50*a* of the tube cap 46*a* can a female thread, or vice versa. In one example, the latch head assembly 22*a* is held in a fixed position while the core tube assembly 20*a* is rotated to engage the thread on the wall 50*a* with the thread on the surface 70. In this example, the T-bar 58 coupled to the plunger 56 can be used to prevent the rotatable portion of the latch head assembly 22*a* (e.g., and the portion including first coupling 32 in FIG. 2) from rotating while the core tube assembly 20 is rotated to form the threaded connection. In the example shown in FIG. 8, the plunger 56 is biased upwardly by a spring 72. FIG. 9 shows a threaded connection 74 formed between the latch head 22*a* and the core tube assembly 20*a*.

Figure 3:
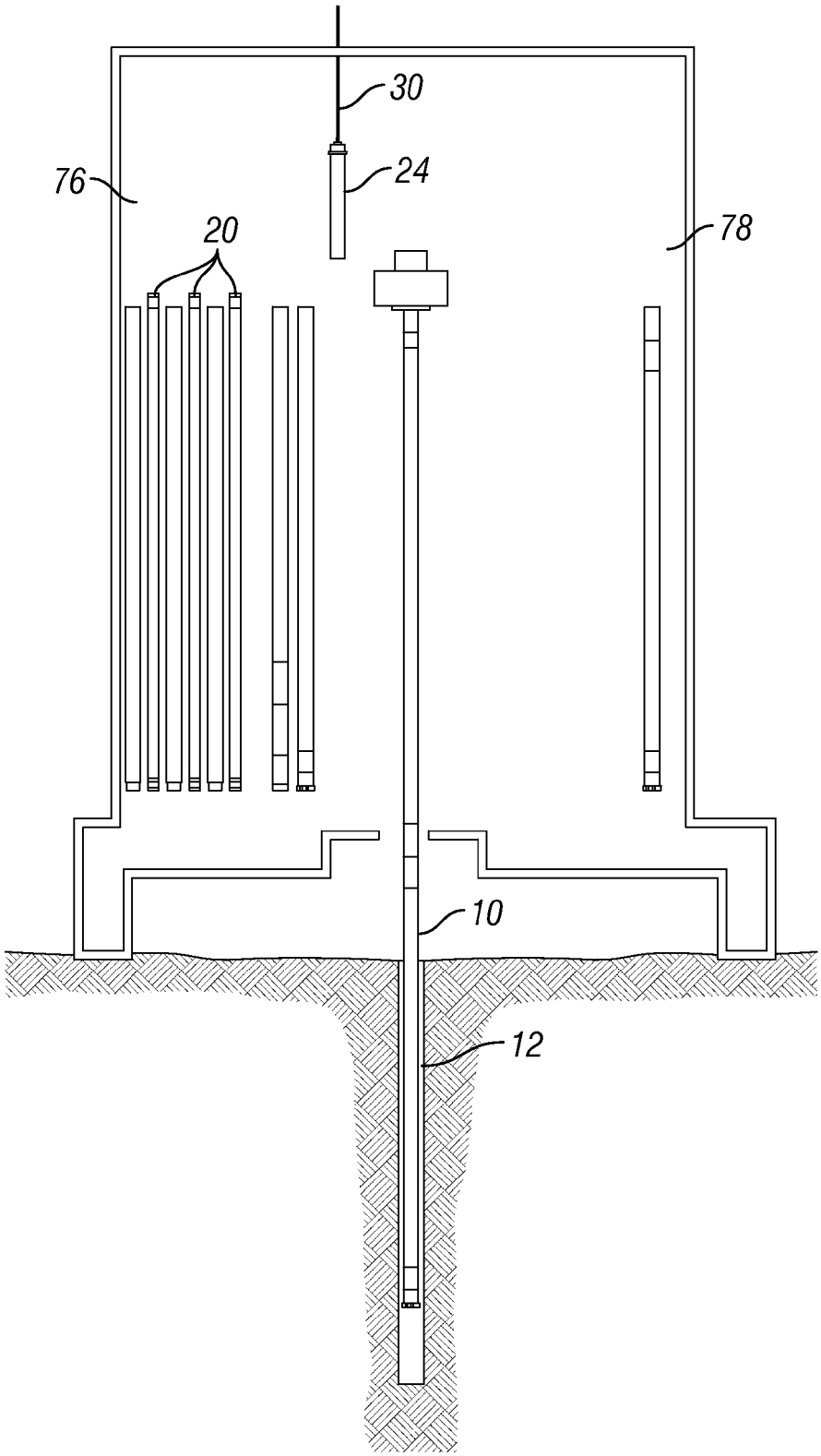
FIG. 3 shows a core sample receiving apparatus in a storage state.
Figure 4:
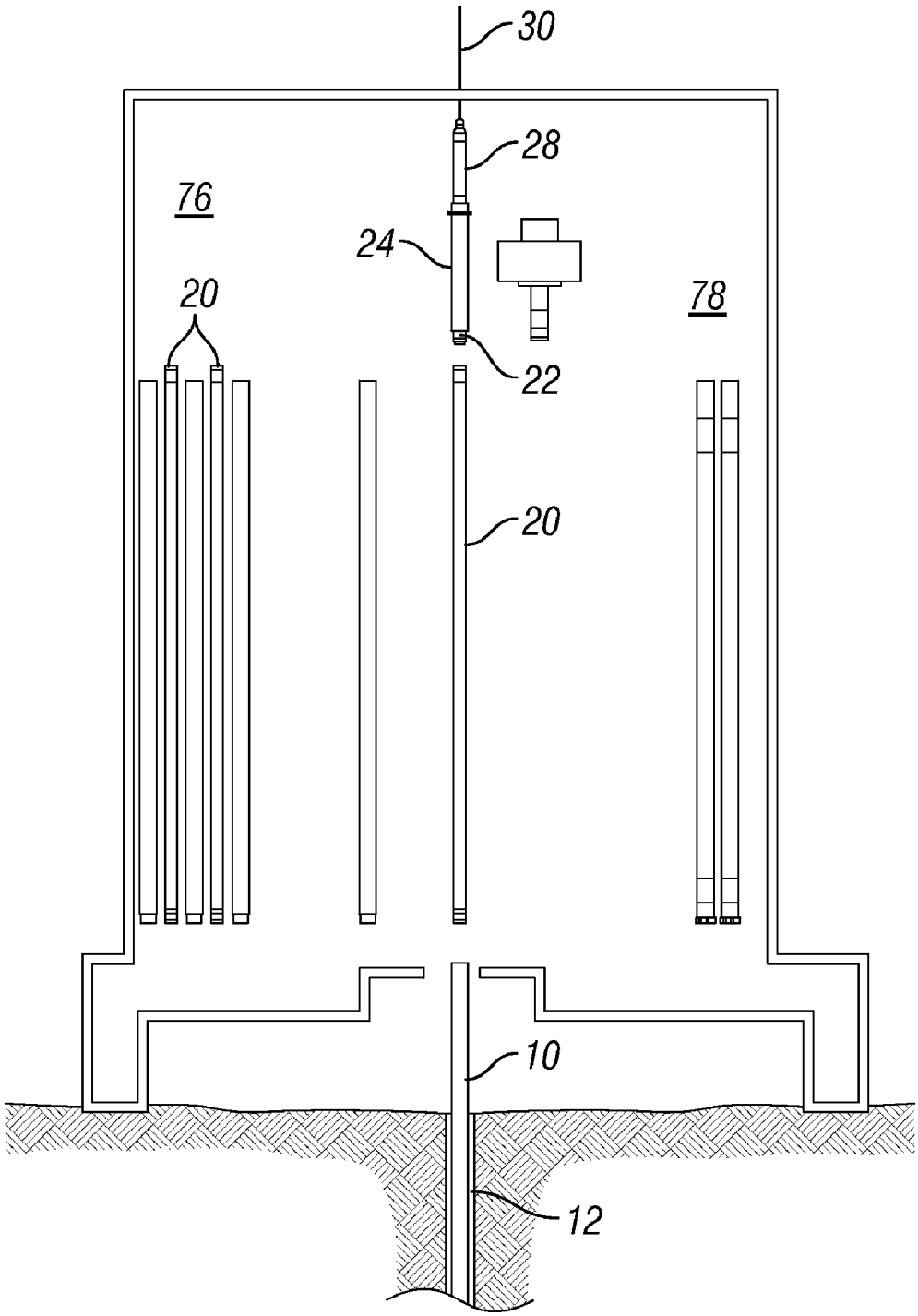
FIG. 4 shows a core tube assembly retrieved from a storage area and positioned below a guide tube containing a latch head.
Figure 5:
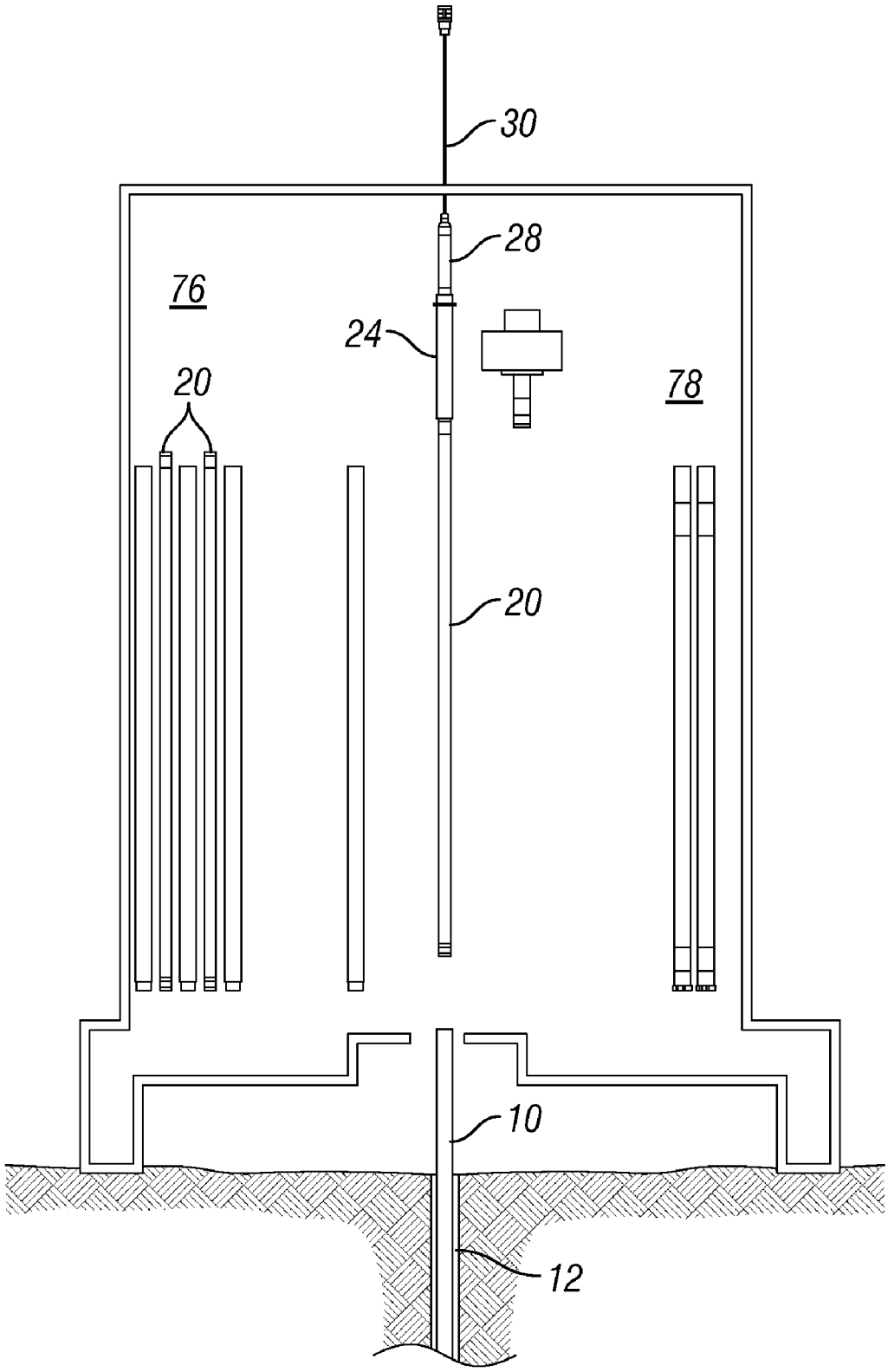
FIG. 5 shows a core sample receiving apparatus ready for deployment into a drill string.
Figure 6:
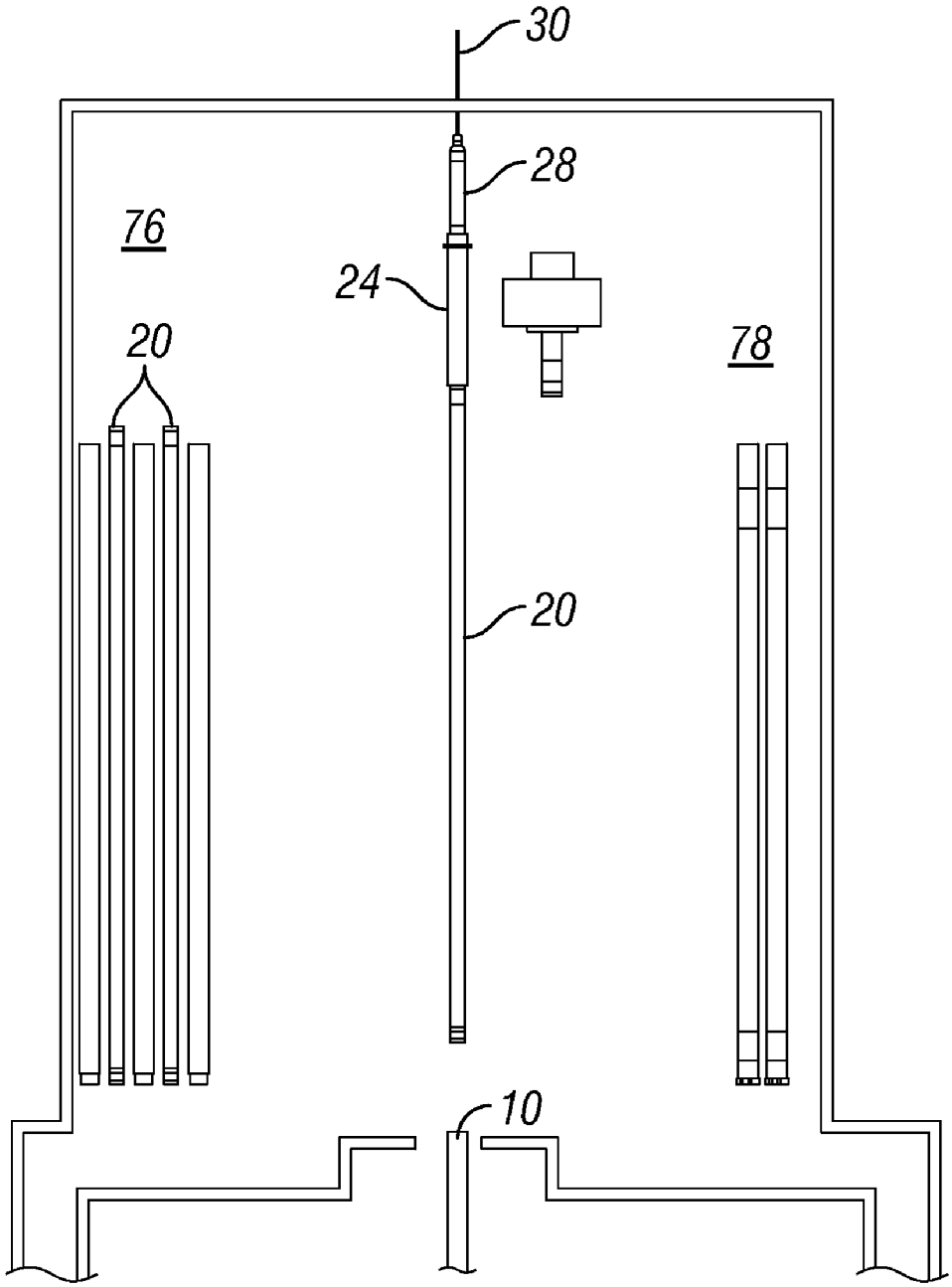
FIG. 6 shows the core sample receiving apparatus of FIG. 5 after retrieval from the drill string.
Figure 7:
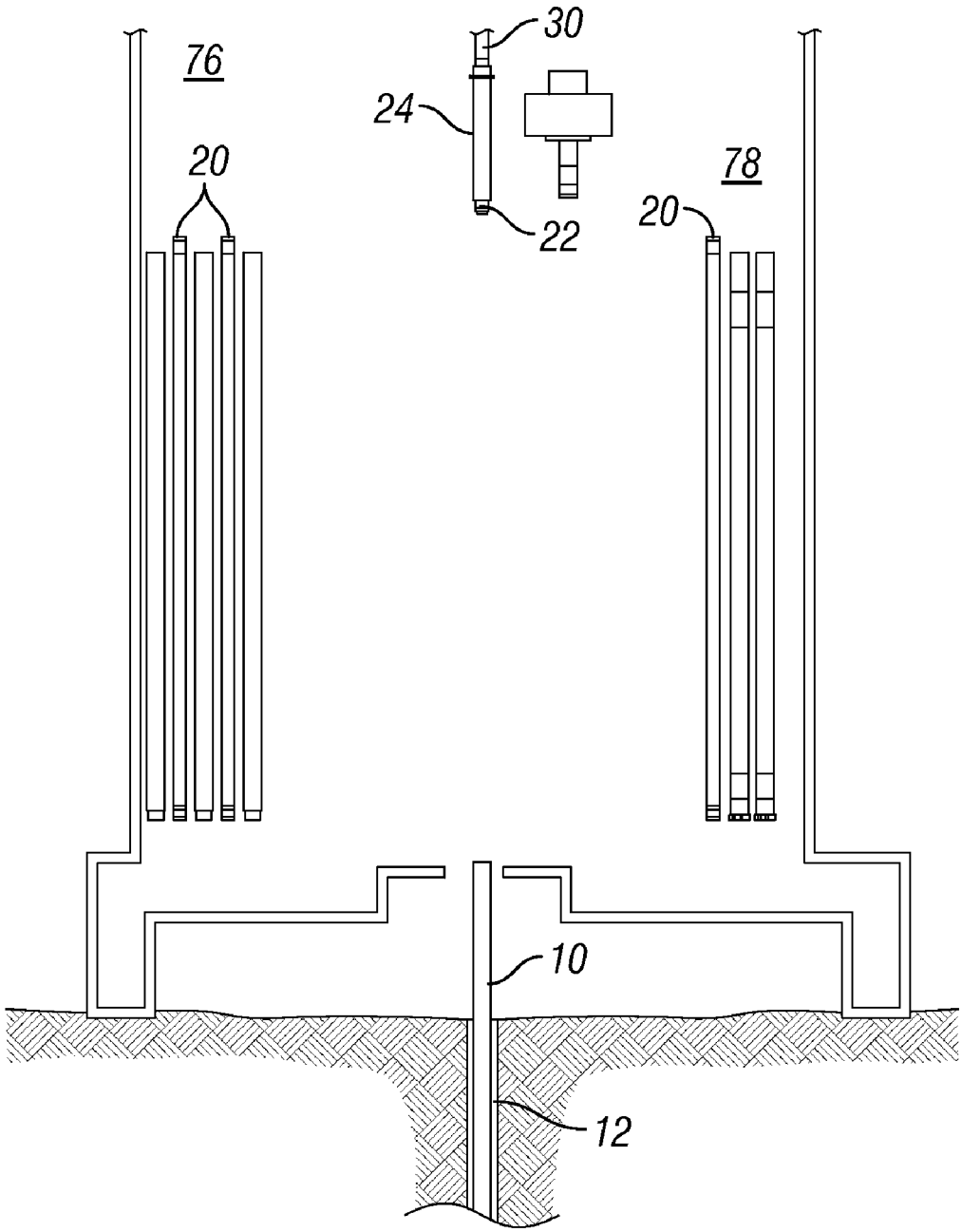
FIG. 7 shows a core tube assembly filled with core sample detached from a latch head disposed in a guide tube and disposed in a storage area

FIGS. 3-7 illustrate a typical core drilling operation using the core receiving apparatus described above. In FIG. 3, a plurality of core tube assemblies 20 are arranged in a staging area 76 along with other tubular components. None of the core tube assemblies 20 has yet been used to retrieve core samples. The latch head assembly (22 in FIGS. 1-2 or FIG. 8) is aligned with the receiving device (28 in FIGS. 1-2) by the guide tube 24. The wireline 30 attached to the retrieving device (28 can be seen extending from one side of the guide tube 24. The setup also includes a drill string 10 inserted in a borehole 12. When it is time to collect a core sample, an empty core tube assembly 20 is retrieved from the staging area 76 and is positioned below the guide tube 24, as shown in FIG. 4. In this position, the latch head assembly 22 protrudes below the guide tube 24 to allow a releasable connection with the tip of the core tube assembly 20 as explained above. FIG. 5 shows the core receiving apparatus ready to be lowered into the drill string 10 for the purposes of collecting a core sample. After the coring run is complete, the core receiving apparatus is retrieved from the drill string 10, as shown in FIG. 6. A force is applied to the latch release surface of the latch head assembly 22 as explained above, which causes the core tube assembly 20 to be released latch head assembly 22. Then, as shown in FIG. 7, the core tube assembly 20 with the core sample is placed in a storage area 78. The above cycle is repeated to collect core samples into each of the core tube assemblies 20 in the staging area 76.

One or more aspects of the invention may provide one or more advantages. First, the latch head is detachable from the core tube assembly, allowing storage of the core tube assembly separately from the latch head. Second, detaching of the latch head from the core tube assembly can be accomplished either remotely or locally by a mechanical procedure, as the application demands. Third, making the latch head detachable from the core tube assembly allows a single latch head to be used with multiple core tube assemblies, which can increase the efficiency of a core drilling operation as well as reduce the amount of space required to store the core drilling/receiving apparatus.

What is claimed is:

1. A latch head assembly for a core receiving apparatus including a core tube assembly and a retrieving device, the latch head assembly comprising:

a support;

a first coupling coupled to a first end of the support for releasably engaging the retrieving device, wherein the first coupling comprises a spearhead for releasably engaging the retrieving device; and a second coupling remotely operable from a surface of a body of water coupled to a second end of the support for releasably engaging the core tube assembly, wherein the second coupling comprises a latch for releasably engaging the core tube assembly, the remotely operable coupling configured to engage to another core tube assembly while the core receiving apparatus is disposed in a body of water without retrieval thereof to the water surface.

2. The latch head assembly of claim 1, wherein a mechanism for releasing the latch comprises a latch release surface disposed between the first coupling and the second coupling, the latch being releasable from the core tube assembly by applying a force to the latch release surface.

3. The latch head assembly of claim 2, wherein the mechanism for releasing the latch further comprises a plunger coupled to the latch release surface and movable to apply a force to the latch, thereby releasing the latch.

4. The latch head assembly of claim 3, further comprising a mechanism for displacing the plunger.

5. The latch assembly of claim 2, further comprising a guide tube into which the support, first coupling, and second coupling are slidable.

6. The latch assembly of claim 5, wherein the guide tube comprises a surface for applying a force to the latch release surface.

7. The latch assembly of claim 6, further comprising a mechanism for selectively preventing rotation of the second coupling relative to the core tube assembly.

* * * * *